US006892725B2

(12) United States Patent
Frund

(10) Patent No.: US 6,892,725 B2
(45) Date of Patent: May 17, 2005

(54) PROTECTIVE HOODS AND NECK SEALS FOR USE THEREIN

(75) Inventor: Zane N. Frund, Cranberry Township, PA (US)

(73) Assignee: Mine Safety Appliances Company, Pittsburgh, PA (US)

( * ) Notice: Subject to any disclaimer, the term of this patent is extended or adjusted under 35 U.S.C. 154(b) by 0 days.

(21) Appl. No.: 10/133,857

(22) Filed: Apr. 26, 2002

(65) Prior Publication Data

US 2003/0200966 A1 Oct. 30, 2003

(51) Int. Cl.[7] ..... A62B 17/00

(52) U.S. Cl. ..... 128/201.29; 128/201.22; 128/201.23; 128/201.25; 128/206.12

(58) Field of Search ..... 128/201.19, 201.22, 128/201.23, 201.24, 201.25, 201.29, 202.19, 206.12; 2/202, 457, 2.17, 2.5, 410, 7, 8, 468, 2.15, 5, 6.1, 6.6

(56) References Cited

U.S. PATENT DOCUMENTS

| | | | | | |
|---|---|---|---|---|---|
| 4,231,359 | A | * | 11/1980 | Martin | 128/201.18 |
| 4,236,514 | A | * | 12/1980 | Moretti | 128/201.23 |
| 4,619,254 | A | * | 10/1986 | Moretti et al. | 128/201.23 |
| 4,683,880 | A | | 8/1987 | Werjefelt | |
| 4,793,342 | A | | 12/1988 | Haber et al. | |
| 4,862,147 | A | | 8/1989 | Thomas | |
| 4,889,113 | A | * | 12/1989 | Pelloux-Gervais et al. | 128/201.25 |
| 4,896,665 | A | | 1/1990 | Gervais | |
| H805 | H | * | 8/1990 | Schriver et al. | 128/201.22 |
| 5,113,854 | A | * | 5/1992 | Dosch et al. | 128/201.23 |
| 5,115,804 | A | | 5/1992 | Brookman | |
| 5,146,636 | A | | 9/1992 | De La Pena | |
| 5,181,506 | A | * | 1/1993 | Tardiff et al. | 128/201.22 |
| 5,186,165 | A | | 2/1993 | Swann | |
| 5,214,803 | A | | 6/1993 | Shichman | |
| 5,226,409 | A | | 7/1993 | Bower et al. | |
| 5,315,987 | A | | 5/1994 | Swann | |
| H1316 | H | * | 6/1994 | McGuinness | 128/201.25 |
| 5,452,712 | A | | 9/1995 | Richardson | |
| 5,653,225 | A | * | 8/1997 | Schegerin | 128/201.24 |
| 5,819,728 | A | * | 10/1998 | Ritchie | 128/201.23 |
| 6,158,429 | A | * | 12/2000 | Gardner et al. | 128/201.25 |
| 6,176,239 | B1 | * | 1/2001 | Grove et al. | 128/206.24 |
| 6,247,471 | B1 | | 6/2001 | Bower et al. | |
| 6,340,024 | B1 | * | 1/2002 | Brookman et al. | 128/201.25 |
| 6,371,116 | B1 | * | 4/2002 | Resnick | 128/206.24 |
| 6,450,165 | B1 | * | 9/2002 | Silver et al. | 128/206.21 |
| 6,460,538 | B1 | * | 10/2002 | Kemp | 128/201.22 |

FOREIGN PATENT DOCUMENTS

| | | |
|---|---|---|
| EP | 1 086 720 | 3/2001 |
| GB | 2 349 796 A | 11/1908 |
| GB | 2 226 490 A | 7/1990 |
| GB | 2 247 175 A | 2/1992 |
| GB | 2 332 436 | 6/1999 |
| WO | 89/00873 | 2/1989 |

OTHER PUBLICATIONS

XP–002246060 Abstract of CN 1 056 701 A (Jinan Inst No 53 Ministry of M (CN), (Apr. 12, 1991), Title: Polyurethane Complementary Networks Adhesive and Its Making Method.

* cited by examiner

*Primary Examiner*—Henry Bennett
*Assistant Examiner*—Mital Patel
(74) *Attorney, Agent, or Firm*—James G. Uber; Henry E. Bartony, Jr.

(57) ABSTRACT

A neck seal for use in a protective hood includes an inner section including a passage for donning. The inner section is fabricated from an elastomeric material to form a seal around a neck of a user. The neck seal also includes an outer section adhered to the inner section. The outer section is fabricated from a material heat sealable to a hood covering material. In one embodiment, the elastomeric material of the inner section is a latex material. The outer section can, for example, be fabricated from a thermoplastic material. In one embodiment the thermoplastic material is a polyurethane such as a polyester-based polyurethane.

20 Claims, 4 Drawing Sheets

PROTECTIVE HOODS AND NECK SEALS FOR USE THEREIN

BACKGROUND OF THE INVENTION

The present invention relates generally to protective hoods and neck seals for use in protective hoods and, more particularly, to protective hoods and neck seals for use therein in which a multi-component neck seal is heat sealed to the head covering or hood portion of the protective hood.

There is an ever-increasing threat of release of chemical and biological warfare agents into public locations such as office buildings and subway systems. As a result of this trend, it has become increasingly important to provide the occupants of these spaces with emergency protective devices for such agents. In that regard, even brief inhalation and exposure of the eyes to airborne toxic chemical and biological agents (associated, for example with terrorist activity) pose a serious threat to unprotected individuals. For example, agents such as Sarin are lethal in dosages as low as of 100 $mg/m^3$-minute.

While it is well known to use gas masks for protection against chemical and biological warfare agents, hoods typically have not been used for that purpose. However, a number of protective hoods are asserted to provide effective respiratory and eye protection against toxic substances present in environments including smoke and fire. One such device is described in U.S. Pat. No. 5,226,409. That device is purportedly suitable for protection against toxic fumes and includes a four-layer laminated head covering. The head covering is tubular in configuration with a closed top, and a bottom end having a neck seal with an opening to permit the entry of the user into the hood. The neck seal includes a flat elastomeric (for example, natural rubber or silicone rubber) annular ring having a circular opening in its center and a central flange extending upwards from the opening perpendicular to the surface of the ring. At the periphery, a circumferential flange extends downward and generally perpendicular to the surface of the annular ring and is bonded to the sidewall of the head covering. It is practically impossible, however, to heat-seal a crosslinked elastomer to a thermoplastic.

U.S. Pat. No. 5,146,636 describes a heat and smoke protective hood including a bag-like head covering fabricated from a heat resistant, gas-impermeable sheet material (that is, polyimide) adapted to fit loosely over the head of the wearer. The protective hood also includes a filter (activated carbon cloth) provided in an aperture of the hood covering to remove toxic substances and harmful ingredients from air inspired by the wearer. A flame retardant annular skirt (fabricated from, for example, an aromatic amide) is attached to the circumference of the head covering, and an elastic neck seal portion (for example, latex or Neoprene latex sheet) is attached to the opening of the head covering.

U.S. Pat. No. 4,683,880 discloses a protective head covering including a transparent, tubular portion fabricated from KAPTON available from DuPont (a polyimide film). The protective covering has a closed upper end and a lower skirt portion adapted to fit over at least the head of the user. A resilient, annular neck seal (for example., silicone sheeting) is adhesively bonded to the interior of the tubular head covering.

U.S. Pat. No. 5,113,854 discloses a protective hood assembly for respiratory protection from smoke and noxious gases. The assembly includes a clear Teflon film hood having a scrubber canister and an exhaust valve. A neck seal is connected to the lower marginal edge of the hood. A spring-like hoop is also connected to the lower marginal edge of the hood. A bib is carried by the spring-like hoop and supports an oxygen generator. A neck seal carried by the lower marginal portion of the hood engages the neck of the user when the hood is donned over the head of the user.

Certain of the materials used in currently available protective hoods are generally unsuitable to protect against chemical and biological warfare agents. Moreover, the neck seal portions of currently available protective hood devices are inadequately attached to the head covering of the protective hoods. In that regard, not only must the neck seal be impermeable to toxic agents and sufficiently elastic to accommodate a wide range of head sizes, it must also securely attach to the hood covering. In many current protective hoods as, for example, described above, adhesive bonding is used to attach the neck seal directly to the hood. In such an attachment, however, it is very difficult to maintain an adequate adhesive chemical bond between the head covering material (for example, a polyimide or a fluoropolymer) and an elastic neck seal material. Over time, the strength of the adhesive bond to the head covering material decreases thereby permitting toxic agents to enter into the hood. This phenomenon is accelerated if the hood is stored at elevated temperatures (for example, in excess of 105° F.).

It is, therefore, desirable to develop protective hoods that substantially reduce or eliminate the above problems.

SUMMARY OF THE INVENTION

In one aspect, the present invention provides a neck seal for use in a protective hood including an inner section including a passage for donning. The inner section is fabricated from an elastomeric material to form a seal around a neck of a user. The neck seal also includes an outer section adhered to the inner section. The outer section is fabricated from a material heat sealable to a hood covering material. In one embodiment, the elastomeric material of the inner section is a latex material. The outer section can, for example, be fabricated from a thermoplastic material. In one embodiment the thermoplastic material is a polyurethane such as a polyester-based polyurethane.

In another aspect, the present invention provides a protective hood including a head covering hood section and a neck seal heat sealed around a periphery of a lower opening in the head covering. As described above, the neck seal includes an inner section including a passage for donning and is fabricated from an elastomeric material to form a seal around a neck of a user. The neck seal also includes an outer section adhered to the inner section. The outer section is fabricated from a material heat sealable to the head covering material.

The head covering can, for example, be fabricated from a material that is resistant to biological and chemical warfare agents. However, the protective hoods of the present invention are usable in generally any environment in which it is desirable to protect a user against injury from toxic agents. The head covering can, for example, be a laminate material. In one embodiment, the head covering included a nylon layer between two polyvinyl chloride-layers.

The head covering of the protective hood can also include a lens to fit over the wearer, a flexible cup with supporting straps to cover the oral/nasal region of the wearer, an air-purifying element attached directly to the hood to remove toxic airborne substances from an inspired airstream, and a skirt located at the bottom of the hood to provide the wearer with additional protection from toxic substances.

The neck seal of the present invention stretches over a user's head and forms a seal around the user's neck to prevent toxic agents from entering the inside of the protective hood. The neck seal enables the user to easily force the user's head into the interior of the protective hood, and also preferably forms an air- and gas-tight seal between the protective hood and the head of the user. The two-component neck seal of the present invention eliminates the need for stitching or adhesively bonding the neck seal to a head covering material (preferably a material of high chemical resistance) via use of a novel intermediate collar or outer section of, for example, a polyester-based urethane polymer.

The protective hoods of the present invention provide a more robust neck seal than available on current protective hoods. The protective hoods of the present invention also provide an individual with excellent respiratory and eye protection from the toxic effects of many agents, including chemical and biological warfare agents that may be released, for example, during a terrorist attack. The protective hoods of the present invention can be stored in a collapsed fashion for extended periods of time in varying environments with no reduction in performance, and used in such environments. The protective hoods of the present invention are lightweight, flexible and compact, enabling, for example, storage in the desk drawer and use by the inhabitants of buildings and any other enclosed structure. Likewise, the compact and portable nature of the protective hoods of the present invention enable potential users to conveniently carry the protective hoods on their person or in their vehicles. Moreover, the neck seal or the protective hoods of the present invention can readily accommodate a broad cross-section of the population, including those having beards and wearing corrective eyewear. Still further, the protective hoods of the present invention are quickly donnable for rapid use in an emergency.

The present invention, along with the attributes and attendant advantages thereof, will best be appreciated and understood in view of the following detailed description taken in conjunction with the accompanying drawings.

DETAILED DESCRIPTION OF THE INVENTION

Figure 1:
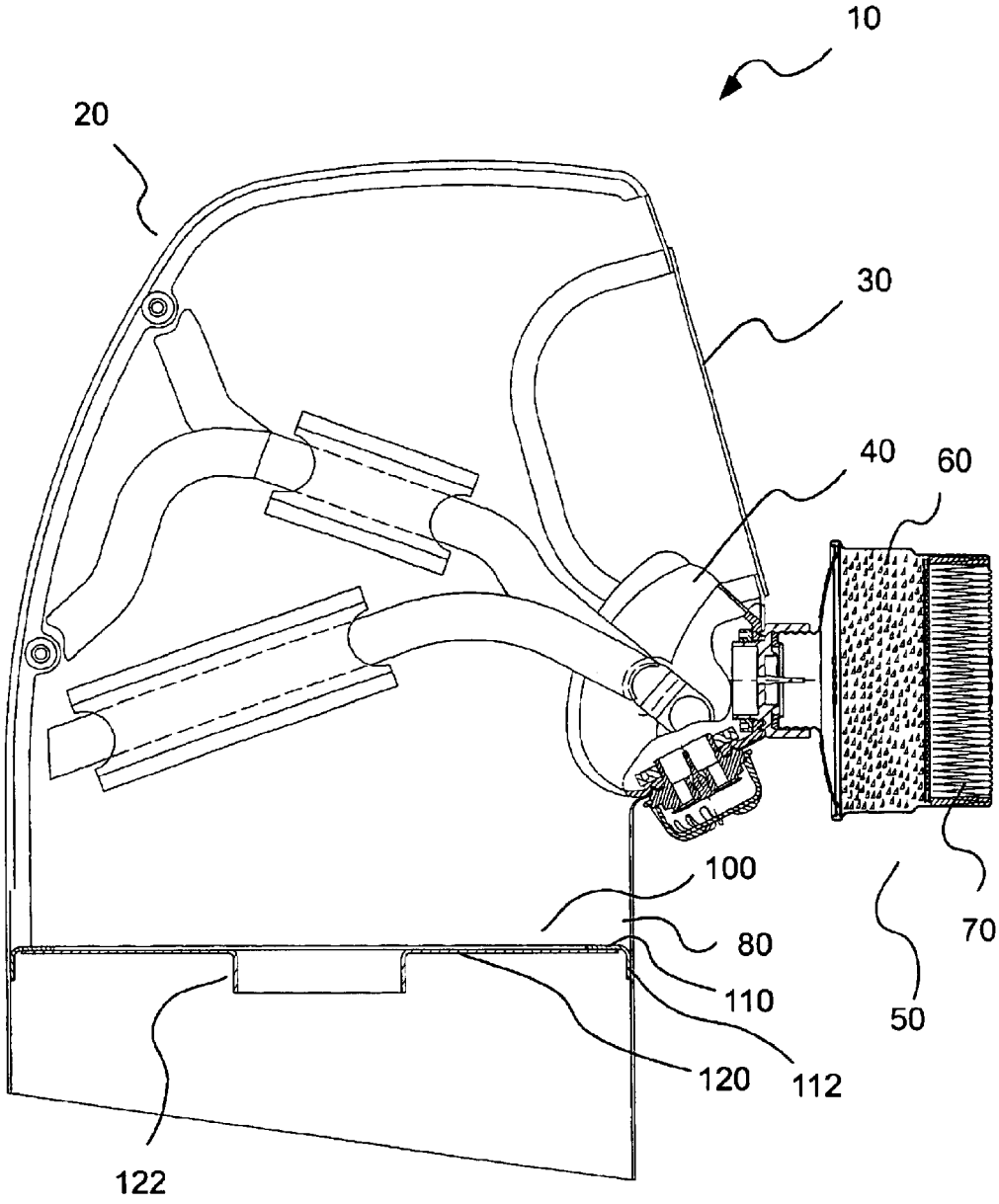
FIG. 1 is a side, cross-sectional view of an embodiment of a protective hood device of the present invention.
Figure 2A:
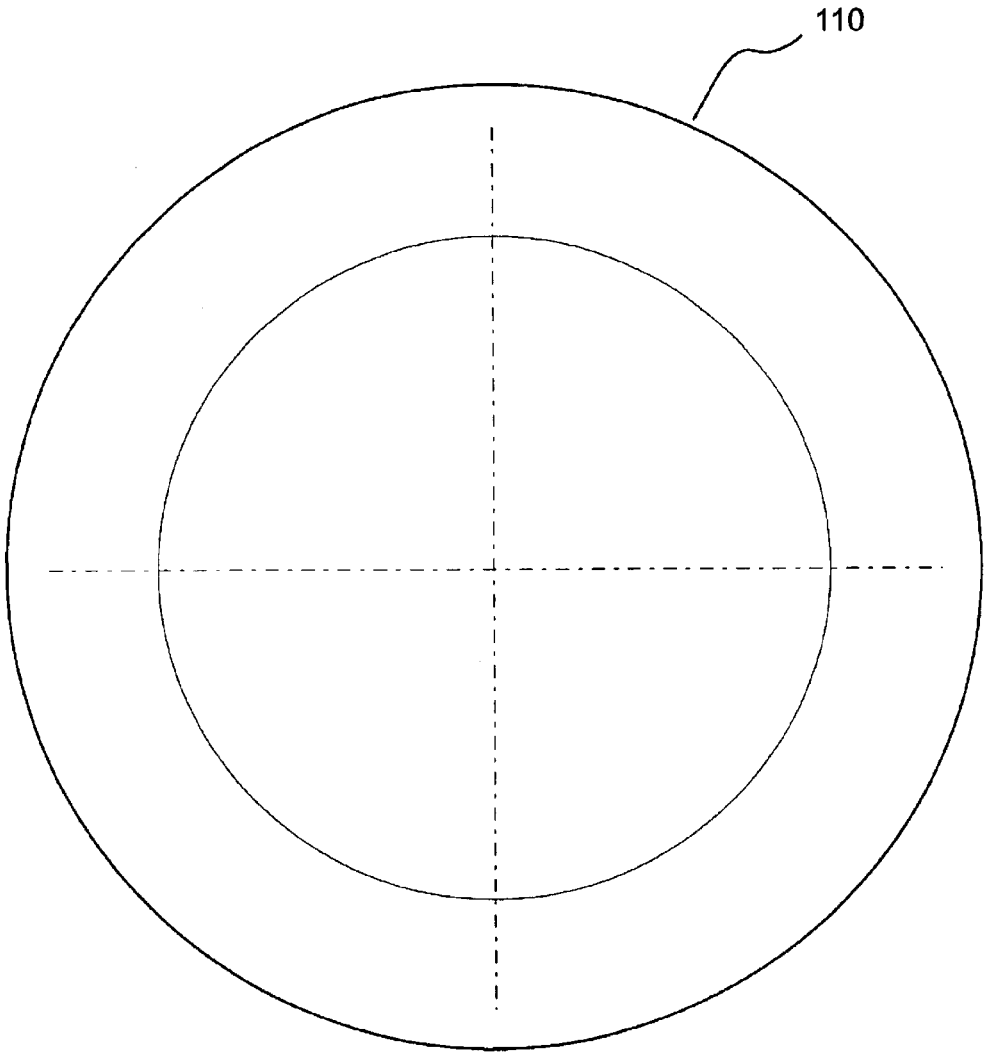
FIG. 2A is a top view of an outer, thermoplastic ring of a neck seal of the protective hood device of FIG. 1.
Figure 2B:
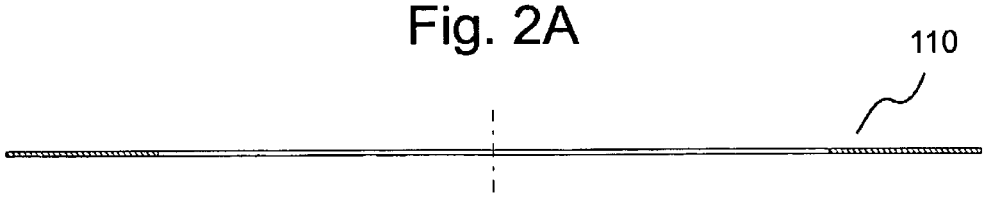
FIG. 2B is a side, cross-sectional view of the outer ring of FIG. 2A.
Figure 3A:
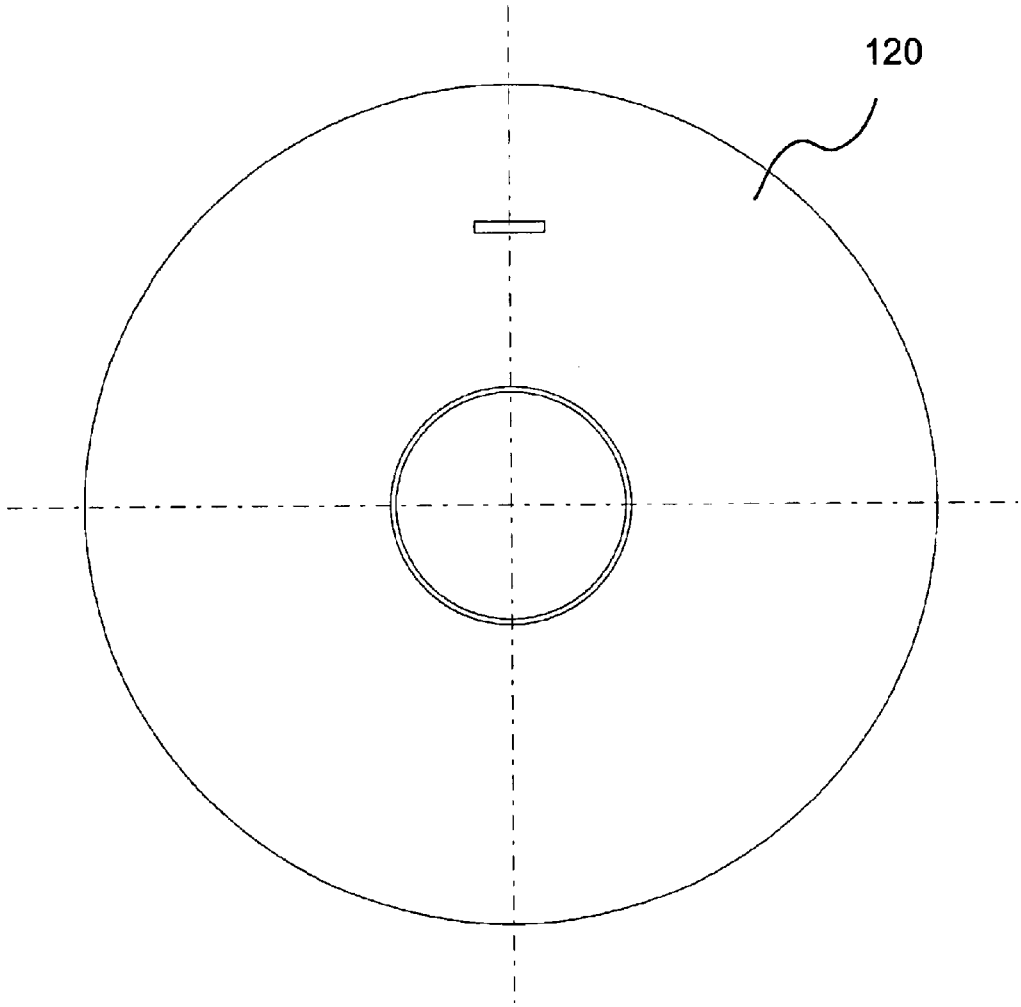
FIG. 3A is a top view of an inner, elastomeric ring of the neck seal of the protective hood device of FIG. 1.
Figure 3B:
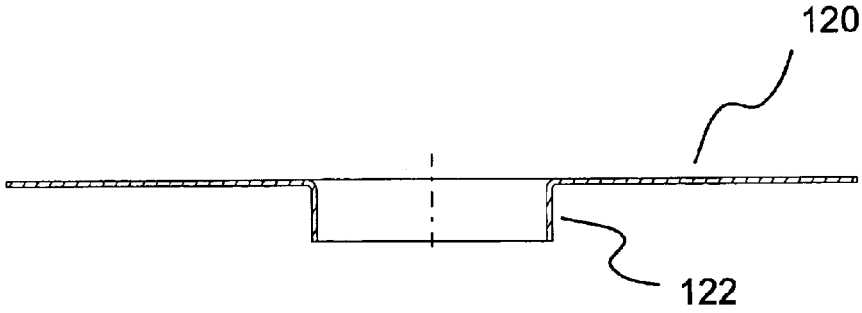
FIG. 3B is a side, cross-sectional view of the inner ring of FIG. 3A.
Figure 4A:
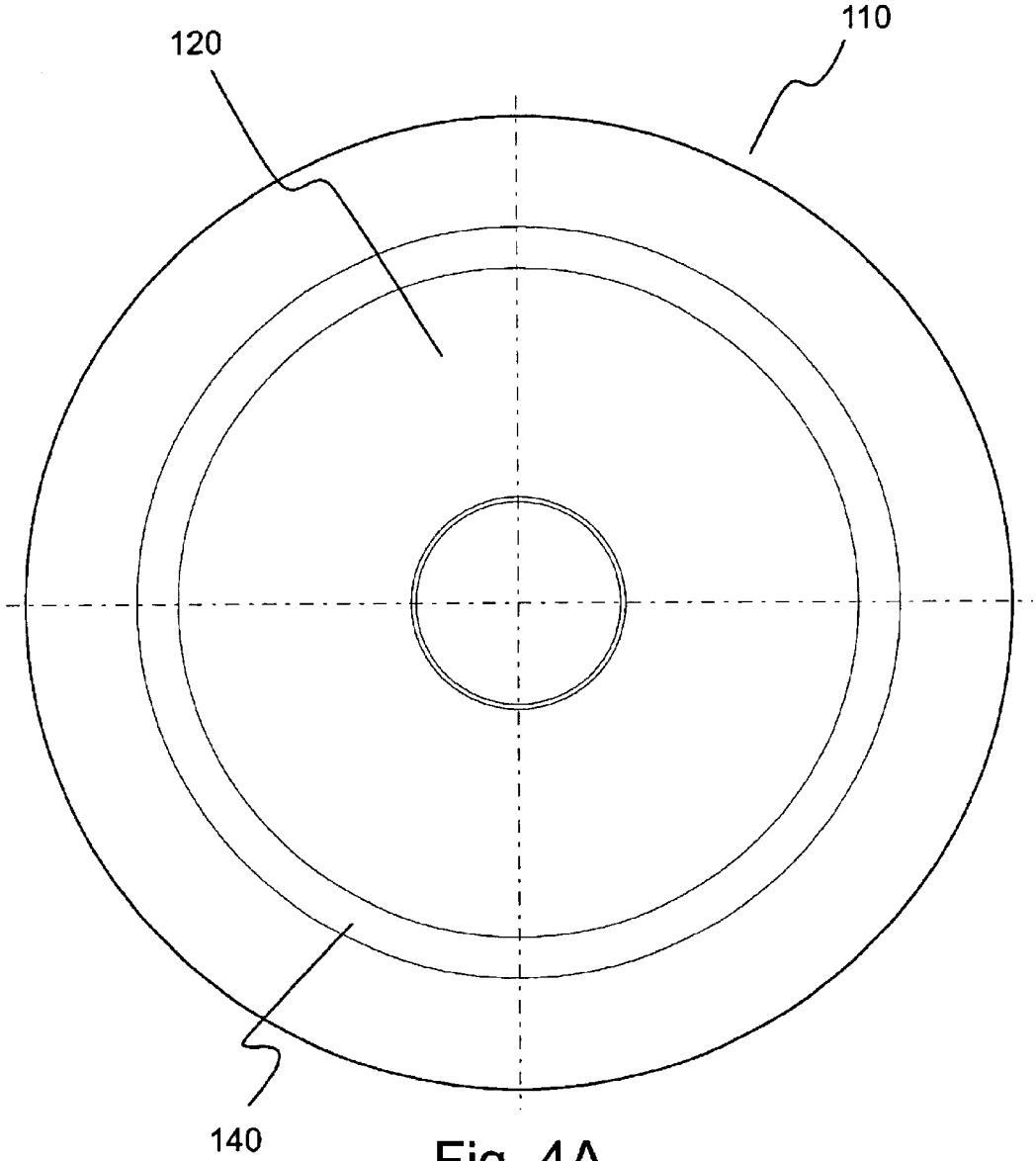
FIG. 4A is a top view of the assembled neck seal of the protective hood device of FIG. 1.
Figure 4B:
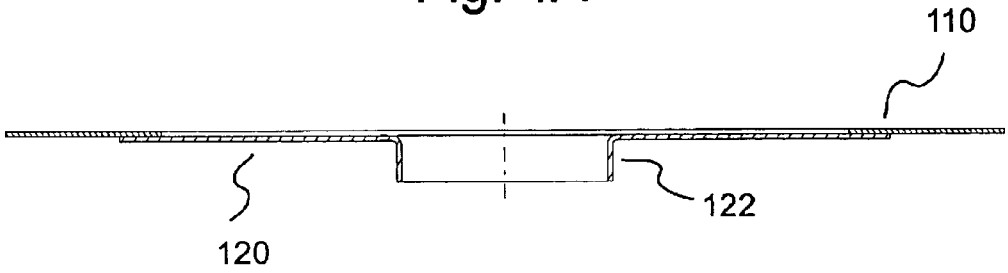
FIG. 4B is a side, cross-sectional view of the assembled neck seal of FIG. 4A.

Protective hood devices of the present invention preferably exhibit the following characteristics, among others: proper fitting of a cross-section of society; adequate protection when exiting from a potentially toxic environment; unobstructed vision when worn; proper function after storage for extended periods of time; and easy and quick donning.

The effectiveness of such protective hoods is dependent on a number of factors including the following: the head covering's and lower skirt's resistance to permeation and penetration by toxic agents; the effectiveness of its air-purifying element to remove toxic substances from an inspired airstream; and the ability of the device's neck seal to maintain a proper seal.

To provide these characteristics, protective hood 10 preferably includes a head covering 20, which is preferably formed from a chemically resistant material such as a three-layer laminate (polyvinylchloride-nylon-polyvinylchloride) that loosely fits over the head of the wearer. As described below, such materials provide protection against an array of toxic agents, including chemical and biological warfare agents that could be released in a terrorist or military attack. An optical quality, monolithic lens 30 as known in the art (which can, for example, be fabricated from pressed polished polyvinyl chloride) is, for example, heat sealed into the viewing area of the hood 10. A flexible nose cup 40 as known in the art can, for example, be fabricated from an elastomer having the necessary shape and flexibility to conform to the oral/nasal regions of a broad range of the population.

Protective hood 10 can also include an air-purifying element 50, which can, for example, be a canister containing a sorbent bed 60 and a high efficiency particulate filter 70. In one embodiment, sorbent bed 60 included Calgon Corporation ASZM, a metal salt impregnated carbon capable of adsorbing many toxic agents and gases. In this embodiment, high efficiency filter 70 was a high efficiency pleated filter 70 as known in the art, which is capable of removing toxic biological agents and particulate matter from the inspired airstream. Protective hood 10 can include multiple purifying elements as known in the art to expand the types of agents against which protection is provided.

Protective hood 10 also includes a novel, two-piece neck dam or seal 100 including two generally concentric sections, elements or rings 110 and 120 securely attached to one another and subsequently attached to a lower, inside peripheral opening 80 of head covering 20. In one embodiment, outer ring 110 was formed of a thermoplastic, polyester-based urethane having excellent resistance to chemical agents, yet capable of being heat sealed to the multi-layer laminate head covering 20, which is of a differing composition. Outer ring 110 is also adhesive bondable to elastomeric inner concentric ring 120, which can, for example, be formed of a cast natural latex rubber compound. Neck seal 100 of the present invention obviates the need for a separate adhesive or adhesive tape often used to attach a neck seal in currently available hoods.

Unlike neck seals or dams used in current protective hoods, the two-piece neck seal 100 of the present invention provides a secure heat-seal to a chemically resistant hood covering and provides a secure adhesive bond to an elastomeric cast latex neck ring. These advantages are attained through appropriate selection of an intermediate, outer ring or section material having the unique characteristics of high tear strength, good resistance to degradation and permeation by chemical agents, and the ability to be both heat sealed and adhesively bonded to materials of differing chemical composition.

The thermoplastic nature of outer ring 110 allows heat sealing of outer ring to head covering 20. In that regard, outer ring 110 preferably has a softening point within the same temperature range as the softening point of head covering 20. To enable adhesive bonding to inner concentric ring 120, outer ring 110 preferably has a suitable chemical structure and morphology. In that regard, the material of outer ring 110 is preferably amorphous and includes reactive or functional groups that bond with the adhesive (for example, a polyurethane adhesive as known in the art). The material of outer ring 110 also preferably has a high surface tension relative to the adhesive to allow wetting of the surface of outer ring 110 with the adhesive.

As described above, inner ring 120 is preferably elastomeric. The material of inner ring 120 also preferably has a suitable chemical structure and morphology to enable adhesive bonding. As described above for outer ring 120, inner ring 110 preferably includes reactive or functional groups suitable to bond with the adhesive. Likewise, the material of inner ring 120 preferably has a high surface tension relative to the adhesive.

The adhesive preferably has a surface tension below the surface tension of the above substrates and chemically reacts with the reactive or functional groups of each of the substrates to form a bond therebetween. The resultant adhesive bond preferably has a strength or pull strength suitable to maintain generally sealed attachment between outer ring 110 and inner ring 120 during use of protective hood 10.

Likewise the material of each of outer ring 110 and inner ring 120 is preferably suitably strong to resist tearing or other failure during use of protective hood 10. Moreover, each outer ring 110, inner ring 120 and the adhesive bond therebetween is preferably resistant to toxic or harmful substances that may be in the environment in which protective hood 10 is used. Parameters for resistance of such material to chemical and biological warfare agents are set forth below.

The components and assembly of one embodiment of neck seal 110 are illustrated, for example, in FIGS. 2A through 4B. Outer ring 110 (see, for example, FIGS. 2A and 2B) is preferably fabricated from a thermoplastic, polyester-based urethane. In one embodiment, outer ring 110 had an outside diameter and an inside diameter of approximately 12 inches and approximately 8.25 inches, respectively. Inner ring 120 (see, for example, FIGS. 3A and 3B) is preferably fabricated from, for example, a cast liquid natural rubber latex that readily stretches over the head of the user. In one embodiment, inner ring 120 had an outside diameter and an inside diameter of approximately 9.25 inches and approximately 2.5 inches, respectively. The inside diameter or neck opening 130 is preferably sized to fit the $5^{th}$ to $95^{th}$ percentile adult population (11.8 to 16.6 inch neck circumference). To assist in providing a secure seal around a user's neck, inner ring 120 can include an extending flange portion 122 for increasing sealing contact with the neck of the user.

As described above, the material of outer-ring 110 was selected for its resistance to permeation by toxic substances, its ability to be heat sealed to the laminate of hood covering 20 (which differs in composition from outer ring 110), and its ability to be adhesively bonded to inner elastomeric (for example, latex) ring 120. The material of inner-ring 110 was selected for its resistance to permeation by toxic substances, its ability to be stretched over that head of a broad range of the population and subsequently retain it original dimension (to provide an adequate seal around the neck), and its high resistance to tearing. Inner ring 120 was adhesively bonded to outer ring 110 by overlapping the two rings concentrically, and bonding them with a urethane adhesive ring 140. In the embodiment of FIGS. 1 through 4B, outer ring 110 overlapped inner ring 120 by approximately 0.50 inch around the inner periphery of outer ring 110.

The assembled two piece, annular neck seal 100 (see FIGS. 1, 4A and 4B) is subsequently attached to the inside periphery of open end 130 of head covering 20 via heat sealing. Neck seal 110 can, for example, be conveniently affixed to the sidewalls of head covering 20 via a circumferential flange 112, as illustrated in FIG. 1. In FIG. 1, circumferential flange 112 extends in a downward direction and is generally perpendicular to the orientation of inner ring 120. Circumferential flange 112 can alternatively extend in an upward direction.

The effectiveness of protective hoods 10 of the present invention was demonstrated by testing against a regiment and requirements established by the Edgewood Arsenal Military Research Center (EDRC) protocol EA-DTL-2239 (to measure the ability of protective hoods 10 to provide a user with protection against chemical and biological warfare agents). Approval by EDRC is a necessary prerequisite for a hood to be viable for use by government personnel. The criteria of the tests and the testing procedures are set forth in the Experimental Section. Satisfaction of these criteria are also believed to be indicative of suitability for use by civilian personnel.

In general, resistance of protecting hoods 10 to permeation by chemical warfare agents Sarin/GB (isopropyl-methyl-phosphonofluoridate), distilled sulfur mustard/HD (β-dichloroethyl sulfide) and CK (cyanogen chloride) was demonstrated. The donning time (as defined below) required for protective hood 10 was less 30 seconds. Resistance of protective hoods 10 to hot temperature storage for 5 weeks was also established. Each one-week period of storage is generally equivalent to a one-year shelf life period.

Experimental

The protective hoods of the present invention were tested according to the Edgewood Chemical Biological Center Detail Purchase Description Document EA-DTL-2239, the disclosure of which is incorporated herein by reference.

I. Protection Factor (PF)

Protection Factor is defined as the ratio of the concentration of the challenge contaminant (concentration outside of the hood) to that within in the breathing zone of the user of the hood; e.g. $PF=Concentration_{outside}/Concentration_{inside}$. The hood Protection Factor (PF) must be at least 500 at the 95% pass rate. Protection Factor (PF) testing of protective hoods 10 of the present invention was performed at the Edgewood Arsenal Research Center Mask Fit Test Facility using six military volunteers. The results of this testing showed that protective hoods 10 can, for example, be used by military personnel and/or by a civilian population in the event of a chemical terrorist attack for escape purposes. Up to four trials were performed on each subject using a corn oil challenge. Corn oil simulates possible biological and chemical warfare agents.

Protection factor tests were performed using a quantitative fit test system including an aerosol generator, an air dilution blower/aerosol distribution system (including, for example, a Laskin type nozzle), a test chamber, a sampling system, an aerosol detector (forward light-scattering photomer), and a data collection system.

Testing was performed using corn oil having a mass mean aerodynamic diameter of 0.4 to 0.6 microns with a geometric standard deviation of 2.0 maximum, and an airborne concentration of 20 to 40 $mg/m^3$. The size of the aerosol particles simulates the particle size of chemical and biological agents.

Each of the volunteers was trained for ten minutes on the proper donning and use of protective hoods 10 of the present invention. The volunteers were then instructed to self-donn the mask and enter the corn oil chamber. Sampling within the mask occurred within the oral-nasal region of the test subjects wearing the hood and performing the following sequence of tasks (each for one minute): (1) Normal breathing; (2) Deep breathing; (3) Turning of head side to side; (4) Moving head up and down; (5) Reciting the "rainbow passage" (see below); (6) jogging in place; (7) Bending over (reaching up and down), and (8) Normal breathing.

The rainbow passage is as follows: "When the sunlight strikes raindrops in the air, they act like a prism and form a rainbow. The rainbow is a division of white light into many beautiful colors. These take the shape of a long, rough arch, with its path high above, its two ends apparently beyond the horizon. There is, according to legend, a boiling pot of gold at one end. People look, but no one ever finds it. When a man looks for something beyond reach, his friends say he is looking for the pot of gold at the end of the rainbow."

Each volunteer performed four trials while wearing protective hood 10. PF values were calculated for each exercise by a Laser Photometer (rear light scattering). The instrument measured leakage into the mask by shining a laser over the cross-sectional area of the sample. If corn oil is present, the laser will refract and register a voltage peak. This voltage peak is then compared to the chamber reading and converted by the instrument into a PF value. The final analysis and pass percentages at each PF level are illustrated in Table 1. Protective hoods 10 attained a 100% pass rate at the 500 PF level.

TABLE 1

| Protection Factor | Frequency | Cumulative Pass Rate, % | Pass Rates, % |
|---|---|---|---|
| 0.0 | 0 | 0.0 | 100.0 |
| 10.0 | 0 | 0.0 | 100.0 |
| 50.0 | 0 | 0.0 | 100.0 |
| 100.0 | 0 | 0.0 | 100.0 |
| 200.0 | 0 | 0.0 | 100.0 |
| 500.0 | 0 | 0.0 | 100.0 |
| 1000.0 | 0 | 0.0 | 100.0 |
| 1667.0 | 1 | 5.0 | 95.0 |
| 2000.0 | 0 | 5.0 | 95.0 |
| 5000.0 | 1 | 10.0 | 90.0 |
| 6667.0 | 2 | 20.0 | 80.0 |
| 10000.0 | 1 | 25.0 | 75.0 |
| 20000.0 | 3 | 40.0 | 60.0 |
| 50000.0 | 3 | 55.0 | 45.0 |
| 100000.0 | 9 | 100.0 | 0.0 |

II. Protection from Chemical Warfare Agents CK and GB

The protective hoods must provide at least 15 minutes protection against cyanogen chloride (CK) gas and GB (Sarin) vapor.

The protective hoods of the present invention were mounted on a headform (for example, the Simulant Agent Resistant Test Manikin or SMARTMAN™ headform) inside an enclosure equipped with a breathing pump. The neck seal of the protective hood was sealed to the headform to prevent leakage. The challenge agent was introduced into the chamber at a rate necessary to maintain the proper agent concentration throughout the 65 minute test period. The concentration of the air inspired by the headform was sampled within the throat and under the eye region of the headform via analytical devices such as a gas chromatograph or the MINICAMS (continuous air monitoring system) of CMS Field Products Group of Birmingham, Ala. Testing confirmed that the protective hoods of the present invention provide an individual with protection against the following agents and exposure conditions for at least 15 minutes.

Cyanogen Chloride (CK)

Challenge concentration: 500+/−25 mg/m$^3$

Prescribed Breakthrough concentration: 2.5 mg/m$^3$

Airflow rate: 50+/−1 Lpm @35+/−2 cycles/min

Air Temperature: 25+/−3° C.

Relative Humidity: 50+/−5%

Sarin Vapor (GB)

Challenge concentration: 1000+/−50 mg/m$^3$

Prescribed Breakthrough concentration: 0.008 mg/m$^3$

Airflow rate: 50+/−1 Lpm @35+/−2cycles/min

Air Temperature: 25+/−3° C.

Relative Humidity: 50+/−5%

III. Protection From Chemical Warfare Agent HD Vapor and Liquid

The protective hood must provide at least 15 minutes of protection when challenged against Mustard gas (B-dichloroethyl sulfide) (both vapor and liquid droplets simultaneously).

The protective hoods of the present invention were mounted on a headform (for example, the SMARTMAN headform) inside an enclosure equipped with a breathing pump. The neck seal of the protective hood was sealed to the headform to prevent leakage. The challenge agent droplets were uniformly distributed over the entire protective hood, and the challenge vapor was introduced into the chamber at a rate necessary to maintain the proper agent concentration throughout the test period. The concentration of the air inspired by the headform was sampled within the throat and under the eye region of the headform via analytical devices such as gas chromatograph as described above. Testing confirmed that the protective hoods of the present invention provide an individual with protection against the following agents and exposure conditions for at least 15 minutes.

Mustard (HD) Vapor

Challenge concentration: 200+/−10 mg/m$^3$

Prescribed Breakthrough concentration: 0.42 mg/m$^3$

Airflow rate: 50+/−1 Lpm @35+/−2 cycles/min

Air Temperature: 25+/−3° C.

Relative Humidity: 50+/−5%

Mustard (HD) Liquid Droplets

Total Challenge Droplet Concentration: 10 g/m$^2$

Individual Droplet Size/Volume: 10–15 microliter

Droplets to be uniformly distributed over entire hood

Prescribed Breakthrough concentration: 0.42 mg/m$^3$

Airflow rate: 50+/−1 Lpm @35+/−2 cycles/min

Air Temperature: 25+/−3° C.

Relative Humidity: 50+/−5%

IV. Maximum Breathing Resistance

The protective hoods must have maximum inhalation and exhalation resistances of 55 and 25 mm of water, respectively, when tested at a continuous airflow rate of 85 liters per minute.

The protective hoods of the present invention were mounted on a headform (e.g. SMARTMAN) equipped with a breathing pump. The neck seal of protective hood 10 was sealed to the headform to prevent leakage. The inhalation and exhalations resistances were monitored in the breathing zone (i.e. nose cup) at a continuous air flow rate of 85 Lpm, and were found to meet the prescribed breathing resistance requirements.

V. Maximum Inspired Carbon Dioxide Gas Concentration

The maximum average inspired carbon dioxide gas concentration in the protective escape hood must not be greater than 2.5% by volume.

The average carbon dioxide content of inspired air was measured for subjects wearing protective hoods while exercising on a treadmill at ambient temperature and humidity. Each subject completed an exercise routine consisting of an initial 5-minute rest period followed by a 15 minute treadmill walk at a pace of 3.5 miles per hour on a level grade. The average carbon dioxide content measured during the exercise period for each subject must not exceed 2.5% by volume. In lieu of a human subject text, a headform test apparatus equipped with a breathing machine can be used to determine inspired carbon dioxide concentration. An acceptable method for measuring the concentration of carbon dioxide inside the protective hood using an automated test is described in "Test for carbon dioxide in inspired gas; open- and closed-circuit apparatus"; maximum allowable limits section of 42 CFR Part 84. The protective hoods of the present invention were found to meet the applicable limit for average carbon dioxide content of inspired air.

VI. Chemical Biological Escape Hood Leakage

The protective hood leakage must not exceed 0.5 cc/min (0.003% smoke penetration)

The protective hoods of the present invention were mounted on a headform (e.g. SMARTMAN) inside an enclosure equipped with a breathing pump. The neck seal of the protective hood was sealed to the headform to prevent leakage. While operating at a breathing rate of 50+/−Lpm @35+/−2 cycles/min, the leakage of aerosol particles into the hood was continuously monitored in the oral-nasal region of the headform using an Hamilton Associates Inc TDA-99A Tester. Testing revealed that the leakage was less than 0.003 penetration.

VII. Donning Time

The protective hood, in its packaged configuration, must be capable of being donned within 30 seconds.

Donning time is defined as the time from which the user of the device begins to open the package until the device is properly mounted on the head of the user. After receiving proper instruction on the use and donning of the protective hood of the present invention, the subjects were able to properly unpackage and donn the device within 30 seconds. In studies of the protective hoods of the present invention, three stages of donning assessed included: 1) time from opening of the package to insertion of the chin into hood neck seal 100; 2) time from opening package to establishing of a seal of protective hood 10 to the neck; and 3) time for complete donning including final adjustments for fitting nose cup 40 and positioning of protective hood 10. The donning times of protective hood were assessed with three volunteers. The average times for the three donning stages were 6.3±1.5, 11.3±2.9, and 21.3±9.0 seconds, respectively. The 21-second average for complete donning of protective hoods 10 of the present invention met the 30-second criterion set forth above.

VIII. Maximum Weight

The protective hood, in its packaged configuration, must weigh no more than 2.0 lbs.

The weight of the protective hoods of the present invention was below 2.0 lbs. when packaged.

IX. Environmental Resistance

The protective hood must function properly after prolonged storage in its packaged configuration at 71+/−3° C. and <15% relative humidity (RH).

In hot temperature storage studies, three protective hood/respirators 10 were subjected to hot temperature storage at 71° C.+/−3° C. and <15% RH for 1, 3, and 5 consecutive weeks. Protective hoods 10 were equipped with a single, front-mounted filter canister. Protective hoods 10 were packaged in a heat-sealed foil bag. No labels, manufacturers lot numbers, or operational instructions were provided with protective hoods 10. Each of the three protective hoods 10 were placed in the exposure chamber on the same day and one was removed at 1, 3, and 5 week intervals and marked for identification.

Following hot temperature storage, protective hoods 10 were inspected for physical defects in the package, hood, visor, neck dam, nose cup, inhalation/exhalation valves, and suspension system. No defects were noted over the sample period in protective hoods 10 of the present invention.

The foregoing description and accompanying drawings set forth the preferred embodiments of the invention at the present time. Various modifications, additions and alternative designs will, of course, become apparent to those skilled in the art in light of the foregoing teachings without departing from the scope of the invention. The scope of the invention is indicated by the following claims rather than by the foregoing description. All changes and variations that fall within the meaning and range of equivalency of the claims are to be embraced within their scope.

What is claimed is:

1. A neck seal for use in a protective hood comprising: an inner section including a passage for donning, the inner section being fabricated from an elastomeric material to form a seal around a neck of a user; and an outer section formed separately from the inner section and adhered directly to the inner section, the outer section being fabricated from a material different from the material of the inner section, the material of the outer section being a resistant material heat sealable directly to a hood covering material.

2. The neck seal of claim 1 wherein the elastomeric material of the inner section is a latex material.

3. The neck seal of claim 2 wherein the outer section is fabricated from a thermoplastic material.

4. The neck seal of claim 3 wherein the thermoplastic material is a polyurethane.

5. The neck seal of claim 4 wherein the thermoplastic material is a polyester-based, polyurethane.

6. The neck seal of claim 5 wherein the outer section is adhered to the inner section via a polyurethane adhesive.

7. The neck seal of claim 1 wherein the inner section and the outer section are resistant to chemical warfare agents.

8. The neck seal of claim 7 wherein the inner section and the outer section are resistant to biological warfare agents.

9. The neck seal of claim 7 wherein the inner section and the outer section provide at least 15 minutes of protection against chemical warfare agents including CK, Sarin and Mustard gases.

10. A protective hood, comprising: a head covering hood section and a neck seal heat sealed around a periphery of a lower opening in the head covering, the neck seal including an inner section including a passage for donning, the inner section being fabricated from an elastomeric material to form a seal around a neck of a user; and an outer section formed separately and of a different material from the inner section and adhered directly to the inner section, the outer section being fabricated from a material different from the material of the inner section, the material of the outer section being heat sealed directly to the head covering material.

11. The protective of claim 10 wherein the elastomeric material of the inner section is a latex material.

12. The protective hood of claim 11 wherein the outer section is fabricated from a thermoplastic material.

13. The protective hood of claim 12 wherein the thermoplastic material is a thermoplastic polyurethane.

14. The protective hood of claim 13 wherein the thermoplastic material is a polyester-based, polyurethane.

15. The protective hood of claim 14 wherein the outer section is adhered to the inner section via a polyurethane adhesive.

16. The protective hood of claim 10 wherein the head covering, the outer section and the inner section are fabricated from a material that is resistant to biological warfare agents and chemical warfare agents.

17. The protective hood of claim 16 wherein the head covering the outer section and the inner section are fabricated from a material that is resistant to biological warfare agents.

18. The protective hood of claim 16 wherein the protective hood provides at least 15 minutes of protection against chemical warfare agents including CK, Sarin and Mustard gases.

19. The protective hood of claim 16 wherein the head covering is a laminate material.

20. The protective hood of claim 16 wherein the head covering includes a nylon layer between two polyvinyl chloride-layers.

* * * * *